166-66

10/14/86 XR 4,616,700 SR

United States Patent [19]

Wood et al.

[11] Patent Number: 4,616,700

[45] Date of Patent: Oct. 14, 1986

[54] AUTOMATIC WELL TEST SYSTEM AND METHOD

[75] Inventors: John R. Wood; Margaret M. Siska, both of Houston; Patrick A. Raymond, Sugarland, all of Tex.

[73] Assignee: Hydril Company, Los Angeles, Calif.

[21] Appl. No.: 652,175

[22] Filed: Sep. 18, 1984

[51] Int. Cl.[4] ..... E21B 34/16; E21B 43/12; E21B 43/34

[52] U.S. Cl. ..... 166/250; 166/64; 166/66; 166/91; 166/267

[58] Field of Search ..... 166/53, 64, 66, 91, 166/267, 336, 337, 357, 369, 250

[56] References Cited

U.S. PATENT DOCUMENTS

| | | | |
|---|---|---|---|
| 3,045,750 | 7/1962 | Peters et al. | 166/64 X |
| 3,219,107 | 11/1965 | Brown, Jr. et al. | 166/53 X |
| 3,366,173 | 1/1968 | McIntosh | 166/357 X |
| 3,526,276 | 9/1970 | Bennett et al. | 166/53 X |
| 3,602,302 | 8/1971 | Kluth | 166/336 |
| 3,614,761 | 10/1971 | Rehm et al. | 166/250 X |
| 3,643,736 | 2/1972 | Talley, Jr. | 166/267 X |
| 3,982,589 | 9/1976 | Wilson et al. | 166/53 |
| 4,159,036 | 6/1979 | Wilson et al. | 166/267 |

*Primary Examiner*—George A. Suchfield
*Attorney, Agent, or Firm*—Dodge, Bush & Moseley

[57] ABSTRACT

A well test system for automatically testing a plurality of wells in an oilfield is disclosed. The system includes means for detecting leaking diverter valves. The system also includes means for purging a test separator as a function of the number of free water dumps and the number of emulsion oil dumps or for alternatively controlling the purging of the test vessel or separator as a function of time or alternatively as a function of the first to occur of a predetermined number of dumps being achieved or predetermined time having elapsed. The system also has means for determining leaking or stuck open dump valves in the water leg or emulsion oil line of the system.

8 Claims, 1 Drawing Figure

AUTOMATIC WELL TEST SYSTEM AND METHOD

BACKGROUND OF THE INVENTION

1. Field of the Invention

This invention relates in general to automatic well test systems for sequentially testing individual wells in an oilfield. In particular, the invention relates to the automatic sequential testing of a plurality of producing wells through the use of a stand alone microprocessor based control system adaptable for various kinds of equipment used in oil fields across the world.

2. Description of the Prior Art

Oil as it is produced from the well normally contains not only oil but various amounts of gas and water as well. Wells also produce debris such as sand and the like in addition to oil, gas and water. Multiple wells are usually connected to a "production station", where the water and gas are separated from the oil. It is usually necessary to determine the amount of oil, gas and water produced on a well by a well basis. However, rather than provide separation and measurement devices for each well, the wells are commonly switched to a single test separator for individual measurements of the wells. The sequential testing of each of the wells in the field is known as "well test" and the cycling of two or more of the wells is known as the "well test sequence".

In a typical production station, each well is brought in on its own flow line to a diverter valve or valves which then route the flow to either a common production header or to a test header. A "header" is simply a pipe in which the flow from any well connected to it can be combined through diverter valves with the flow from all other wells on the header. In a typical production station only one well is diverted to the test header for a well test, while all other wells are diverted to the production header. The flow is then sent to the corresponding separator which may be the test separator corresponding to the test header or to the production separator corresponding to the production header. A separator is a vessel in which the oil/gas/water mixture "rests" for a retention time in order to allow natural separation of the oil, the gas and the water. The gas will "break out", the water will settle to the bottom and the oil will "float" on the water. By tapping the vessel at various levels, the three production components of the well can be selectively retrieved.

The top vent of the separator releases the gas from the well. A middle tap produces oil and a bottom tap produces water. The components are then "metered", and sometimes pressure and temperature compensated, to determine the composition of the well's production. Since some of the water will remain emulsified in the oil, not all of the water produced by the well will be recorded by the water line from the separator. For this reason, the oil of the oil line is referred to as the "oil emulsion" and a measurement in addition to its flow rate is made on the oil emulsion to determine its water content.

Prior art devices have been used to determine the water/oil content of the oil emulsion flowing in the oil outlet by measuring the capacitance of the fluid. Combining that measurement with a flow rate measurement in the oil outlet enables a determination of the net oil and emulsified water flow rate from the well.

A test separator is generally required in order to individually determine the flow characteristics of individual wells, because even though measurements are also performed at a production separator, the flow through the production separator comprises the combined flow of multiple wells. Individual well information is only available by sequentially selecting one well at a time to be routed through the test separator.

After metering and the net oil measurement for each well, the outputs from the free water line and the oil line are usually recombined and routed to the production header for normal production with the remaining wells. By providing the outputs of the test separator back to the production separator, the measurement devices on a production separator represent the "total" production quantities.

Many different configurations of equipment are possible for the test separator. Valving varies from one system to another. Multiple or single separators may be used for the test separator. Instrumentation on the separators varies from one oilfield to another and from one equipment manufacturer to another. Flow rates are different from well to well. The components of the produced well fluid differs from well to well as does the grade of the oil produced.

Still another variation in the kinds of test separators setups in oil fields relates to whether or not two phase or three phase flow is produced. As described above, a test separator having a free water outlet is typical of a "three phase" separator. In areas where water content is low enough that it remains emulsified and does not separate easily from the oil, the flow is referred to as "two phase". Two phase separators do not use internal baffels and weirs to separate free water from the oil emulsion as do three phase separators.

Prior art automatic well test systems have used relay controlled systems for sequentially switching the diverter valves of the wells to the test header for individually testing the wells. Such systems have been inflexible in that each system had to be designed individually for a particular well system. Such systems required individual design because of the large variety of physical equipment associated with test separators used in oil fields across the world. For example, turbine meters or positive displacement measuring devices for measuring flow in the various flow lines could be alternatively used.

Although central supervisory systems have been used in the past with remote terminal units in the field, no stand-alone programmable automatic well test unit has been provided before the invention to the described below.

One of the problems associated with prior automatic well test systems has been that there has been no convenient way to automatically test whether or not the diverter valves are leaking.

Still another problem has existed in prior automatic well test systems in that the purging of the test separator, prior to the test of an individual well, in order to insure that all of the produced fluid from a previous well test has been removed from the separator, has been controlled as a function of purging time. Although purging as a function of time may work satisfactorily where a well is producing at a constant rate, such purging which ordinarily lasts for a relatively long period of time, may be ineffective and inaccurate where a well produces cyclicly.

Still another problem with prior art automatic well test systems has related to the inability to automatically determine whether or not dump valves associated with a test separator are leaking or whether or not they are stuck open.

IDENTIFICATION OF OBJECTS OF THE INVENTION

In view of the problems associated with the prior art automatic well test systems, it is an object of this invention to provide a stand-alone, microprocessor-based automatic well test system which is adaptable for a large variety of equipment and configurations of test separator and test requirements for oil fields all over the world.

It is another object of the invention to provide an automatic well test system which has the capability to determine whether or not a diverter valve from one of the wells connected to the system is leaking prior to conducting a well test.

It is another object of the invention to provide an automatic well test system which controls the purging of a test separator as a function of the number of dumps of oil emulsion, free water or oil emulsion and free water before the testing of the well commences.

It is another object of the invention to provide an automatic well test system in which dump valves in test separator output lines may be automatically monitored to determine whether or not they are stuck open or if they are leaking.

SUMMARY OF THE INVENTION

The objects identified above as well as other advantages and features of the invention are provided in an automatic well test system according to the invention for testing a plurality of wells in an oilfield. A plurality of controllable diverter valves, one valve disposed in each output line of each well is provided where each diverter valve has a divert line and a production line. Each production line is connected to a common production header and a test header is provided to which the divert line of each diverter valve is also connected.

The test header has a test output line which is connected to the input port of a test separator. A flow determining means is disposed in the test header output line for generating a signal indicating flow in the test header output line. A water/oil measuring means is provided in the oil emulsion output line for generating a signal indicative of the ratio of water to oil flowing in that line. A flow rate measuring means is also disposed in the oil emulsion output line for generating a signal indicative of the flow rate of the oil emulsion flowing in the line.

A microprocessor based system controller which is responsive to operator data inputs is provided for automatically testing each well. The system controller, prior to the testing of each well in sequence, signals all of the controllable diverter valves to connect each well to the production header. The connection to the production header is maintained for each well through the production header for a predetermined "wait" time. The system controller monitors the flow determining means in the test header output line and generates an alarm signal if a signal is generated by the flow determining means during the predetermined wait time. The alarm signal signifies that at least one of the diverter valves is leaking via its divert line.

Each well is tested in sequence under the control of the system controller where each of the controllable diverter valves associated with the well directs its output of the well to its divert line and to the test separator. Each well in sequence then is purged via the oil emulsion output line for the case of a two phase separator and also via a free water line in the case of a three phase separator. The automatic well test unit generates, in response to the signal indicative of the water to oil ratio flowing in the oil output line and to the signal indicative of the flow rate of the oil emulsion flowing in the oil output line, a net oil flow rate produced in each well.

According to another aspect of the invention, the test separator is purged of free water and/or oil emulsion according the number of free water dumps and/or the number of emulsion oil dumps occurring after a well has been switched to the test separator. The system controller compares the number of such dumps with respect to operator input data for such dumps and enables the well test when the number of dumps specified by the operator input data has been accomplished.

According to another aspect of the invention, the automatic controlling means generates a leaking dump valve alarm signal if, while a dump valve is closed, the flow rate measuring means in either the oil emulsion output line or the free water output line measures greater than a predetermined flow rate for greater than a predetermined time period. The system also includes means for generating a stuck open dump valve alarm signal if, after a predetermined time required to dump liquid from the test separator, the signal indicative of the flow rate in the output line is greater than a predetermined level.

BRIEF DESCRIPTION OF THE DRAWING

The foregoing summary of the invention and other objects and advantages of the invention will be described in more detail below taken in conjunction with the accompanying drawing of which.

DESCRIPTION OF THE INVENTION

Figure 1:
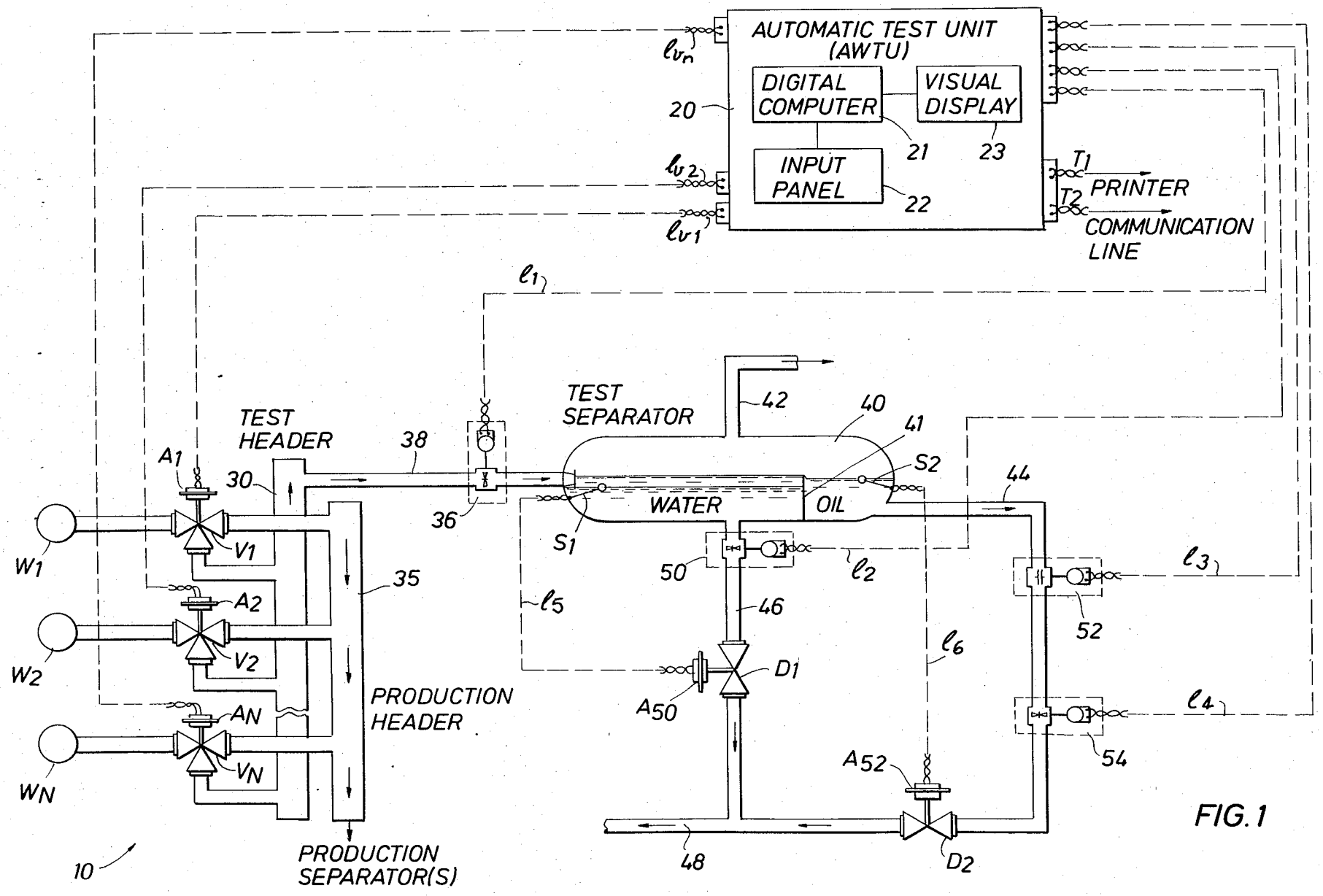
FIG. 1 is a schematic drawing of the automatic well test system according to the invention illustrating the automatic well test unit provided for controlling the output of a number of wells in an oilfield and for connecting them sequentially to a test separator for the purpose of measuring the net oil from each well.

FIG. 1 illustrates schematically an automatic well test system 10. An automatic well test unit 20 is provided including a digital computer 21, preferably a microprocessor, and input panel 22 and visual display 23. The input panel allows information to be input to be digital computer. The visual display 23 allows the user to receive a visual indication of information in the digital computer and to verify input information from the input panel. The automatic well test unit 20 (AWTU) is also provided with output terminal T1 for communicating with a printer for the output of test reports and the like, a terminal T2 is provided to connect the AWTU with a communication line from a central station for receiving commands and sending information.

The AWTU 20 is provided to sequentially control the testing of individual wells, $W_1$, $W_2$, . . . $W_n$ in an oilfield. Each well is provided with a diverter valve $V_1$, $V_2$, . . . $V_n$, the primary output of each of which is applied to a production header 35. Each well may have its output diverted to test header 30 by a command from the automatic well test unit to one of the actuators $A_1$, $A_2$, . . . $A_N$ via respective leads $l_{V1}$, $l_{V2}$, . . . $l_{Vn}$. A test header output line 38 is provided between test header 30 and the input port of a test separator 40. The preferred embodiment illustrates a "three phase" separator having a baffle or weir 41 to separate free water from the oil emulsion. The test separator 40 has an oil output line 44 connected to the oil portion of the separator and a water output line 46 connected to the water portion of the separator. Although not a part of this invention, a gas output line 42 is also provided.

A dump valve D1 is provided in water line 46 which is controlled by means of water level switch S1 activating actuator $A_{50}$ via electrical leads $l_5$. A dump valve D2 is provided in the emulsion oil output line 44 and is actuated by means of oil level switch S2 which communicates with actuator $A_{52}$ via leads $l_6$. The outputs from the free water line 46 and the oil line 44 are preferably recombined and routed through line 48 back to the production header 35.

A flow indicator 36 is provided in test header output line 38 and communicates with the automatic well test unit via leads $l_1$. The flow indicator 36 may alternatively be a turbine meter or a flow/no flow switch. A flow rate indicator 50 is provided in water line 46 and communicates with automatic well test unit 20 by means of electrical leads $l_2$. The flow rate indicator 50 may be a turbine meter or a positive displacement meter. Similarly, a flow rate indicator 54 is provided in oil output line 44 and communicates with automatic well test unit 20 via electrical leads $l_4$ Indicator 54 may be a turbine meter or a positive displacement meter. A basic sediment and water (B,S&W) probe 52 is also connected in series with oil output line 44 and communicates with the automatic well test unit 20 via electrical leads $l_3$.

According to the invention, software is provided in digital computer 21 of the automatic well test unit 20 for sequentially testing each well. The software is illustrated in flowchart tables of the appendix following this description. The software includes a base system illustrated in Table 1 and a well test executive routine illustrated in Tables 2A and 2B. A diverter valve leak alarm program is described by the flow chart of Table 3. A program for controlling purging as a function of the number of dumps is described in Table 4 while the program for controlling purging as a function of time is illustrated in Table 5. The method for controlling purging as a function time or dumps is described in the flow chart of Table 6. Table 7 illustrates a flow chart describing the program used to detect a leaking dump valve. Table 8 illustrates a program used to detect a dump valve which is stuck open. Table 9 illustrates the AWTU reaction to various operator input data options when an alarm is signaled.

Table 1 of the Appendix below illustrates the base system of the software according to the invention. The base system updates the system clock and decrements task timers according to the time intervals shown in Table 1. Likewise, interupts are provided for remote and local communications interrupts. Tasks are run on a priority basis. Hardware scans are scheduled, communications are scheduled and system diagnostics are performed.

Table 2A of the appendix illustrates in an overview diagram the functions performed by the well test executive program according to the invention. Analog measurements of B,S&W, alarms, and average flow are performed respectively each 200 ms., 400 ms. and 1 minute. Meters are processed each 5 seconds. The status of each valve and meter is determined once each minute. Man/machine interfaces are interrupt driven.

Table 2B of the Appendix illustrates the software logic of the well test executive in sequentially testing the wells $W_1$, $W_2$ . . . $W_N$ illustrated in FIG. 1. Logic block 1 indicates that all wells are first diverted to the production header 35. Logic block 2 indicates that a determination is made if the operators has configured the AWTU for testing via input panel 22 of AWTU 20. If so, in logic block 3, a determination is made whether or not operator input has been received requesting testing to begin. In logic block 4, a test number is set at 1 and diverter leak is checked. Details of the diverter valve leak test are shown in Table 3 and discussed below. In logic block 5, a well corresponding to the test number is diverted from production to the test separator vessel 40. In logic block 6, the vessel is purged according to an operator entered parameter. In Table 4, details of controlling purging as a function of operator entered number of dumps is presented. Table 6 shows details of controlling purging as a function of time or number of dumps. Determination of stuck open or leaking dump valves is conducted during their control logic block.

In logic block 7 of Table 2B each well is tested according to operator entered parameters. In logic block 8, each well is switched back to production and the system is again checked for diverter valve leaks. In logic block 9, the test number is incremented. In logic block 10, a determination is made if the testing sequence is complete. If not, processing returns to logic block 5. If so, a beacon is lighted and the software returns the system to logic block 1.

DIVERTER VALVE TESTING

Table 3 of the Appendix illustrates the diverter valve leak alarm function provided by the automatic well test system 10 according to the invention. In logic block 11, all well valves are diverted to production. In logic block 12, a determination is made if a turbine meter is provided in test output line 38. If so, control passes to logic block 13 where a determination is made if the flow rate exceeds an operator entered level for flow rate. If it does, control passes to logic block 14 where a determination is made if time elapsed exceeds a specified time, preferably three minutes. The specified time is selected according to the time required for a valve to close. If the time does not exceed the specified time, control is passed back to logic 13. If the time does exceed the specified time, control is passed to logic block 15 to the alarm subroutine which is described in Table 9.

If logic block 12 determines that a turbine meter is not in test output line 38, control is passed to logic block 16 where a determination is made whether or not a flow/no flow switch is in the test output line. If so, logic block 17 determines if flow is still occurring in the test output line by the status of the switch. If flow is in the test output line, control is passed logic block 18 where a determination is made whether or not time elapsed exceeds a specified time, preferably three minutes. If it does, control is passed to alarm logic 15 explained in detail below in conjunction with Table 9.

PURGING CONTROL AS A FUNCTION OF NUMBER OF DUMPS

Table 4 illustrates the system logic to control purging as a function of an operator entered number of dumps. In logic block 20, a well is diverted to the test vessel. After a wait of a specified time, preferably one second in logic block 21, logic block 22 determines if the number of oil dumps equals the operator entered minimum number. If so, control passes to logic block 23 where a determination is made if the number of water dumps equals the operator entered minimum number. If so, testing of the well is commenced.

The oil meter processor 22 begins in logic block 30 with a wait of five seconds. Control is passed to logic block 31 to determine if a turbine meter is in oil line 44. If so, control is passed to logic block 32 where the flow rate is compared with the operator entered no flow rate. If the flow rate is less than the operator entered no flow rate, control is passed to logic block 33 to determine if the last rate exceeded the operator entered minimum flow rate. If so, the count of oil dumps is incremented and control is passed back to logic block 30.

If there is not a turbine meter at the oil leg, logic block 31 passes control to logic block 35 where it is determined if there is a positive displacement meter in the oil leg. If so, control is passed to logic block 36 where a determination is made if the accumulated counts from the positive displacement meter is zero. If so, control is passed to logic block 37 to determine if the last accumulation is greater than zero. If so, logic block 38 increments the number of oil dumps.

The logic block 23 for the water meter processor is constructed in a similar measure to logic block 22 and for that reason a detailed description of its processing steps is not described again here.

CONTROLLING PURGING AS A FUNCTION OF TIME

Table 5 illustrates the processing method used to control the purging of the test separator as a function of time. After the executive routine has passed control to logic block 5 where the well is diverted to the test separator, control is passed to logic block 50 for a one second wait. Logic block 51 then determines if the current time is greater than the operator entered minimum. If not, control is passed back to control block 50 to increment time by one second. After current time equals the operator entered minimum, control is passed to logic block 52 for the start of testing in the oil leg 44 from vessel 40 (FIG. 1).

CONTROLLING PURGING AS A FUNCTION OF TIME OR DUMPS

Table 6 illustrates the processing method to control the purging of the test separator as a function of time or dumps. After the executive routine has passed control to logic block 5, control is then passed to logic block 60 where a one second wait is implemented. Control passes to logic block 61 where a determination is made if current time equals the operator entered minimum. If yes, testing starts after control is passed to logic block 64. If current time does not equal the operator entered minimum, control is passed to logic block 62 where a determination is made as to whether or not the number of oil dumps equals the operator entered minimum number of dumps. If not, control is passed back to logic block 60. If so, the control is passed to logic block 63 to determine if the numbers of water dumps equals the operator entered minimum. If not, control is passed again to logic block 60. If so, control is passed to logic block 64 where control is established to start the well test.

DETERMINING LEAKING DUMP VALVES

During testing, software is provided for periodically determining whether or not the dumps valves in the water leg or output line 46 and oil leg 44 of the system is leaking. Table 7 illustrates a flow chart of that software. At logic block 70, a determination is made as to whether or not a turbine meter is in oil leg 44. If so, control is passed to logic block 71 to determine if the flow rate exceeds the operator entered no flow rate. If so, control is passed to logic block 72 where the rate is determined to be less than or greater than the operator entered minimum flow rate. If it is less than the operator entered minimum flow rate, logic passes to logic block 73 where elapsed time is compared to three minutes. If it is greater than three minutes, control is passed to logic block 15 where an alarm routine is entered as described below in connection with Table 9 to indicate a leaking dump valve in the oil leg 44.

If a turbine meter is not provided at oil leg 44, logic control is passed to logic block 74 to determine if a turbine meter provided in water leg 46. If so, logic control is passed to block 75 where a determination of the flow rate as compared to the operator entered no flow rate. If it is greater than that rate, control is passed to logic block 76 where the flow rate is compared to the operator entered minimum flow rate. If it is less than that rate, control is passed to logic block 77 where elapsed time is compared with a specified time, preferably three minutes. If it is greater than three minutes, control is passed to logic block 15 to alarm that a leaking dump valve is present in the water leg 46. Table 9 illustrates the alarm logic of the software.

DETERMINING STUCK OPEN DUMP VALVES

During testing, software is provided for periodically determining whether or not the dump valves in the water leg 44 and the oil leg 44 of the system are stuck open. Table 8 illustrates a flowchart of that software. At logic block 80, a determination is made as to whether a turbine meter is in oil leg 44. If so, control is passed to block 81 where a comparison of flow rate and operator entered minimum flow rate is made. If flow rate exceeds the operator entered minimum flow rate, control is passed to logic block 82. If elapsed time exceeds the operator entered time limit, control is passed to logic block 15 where alarm software is present to indicate a stuck open dump valve in the oil leg 44.

If a turbine meter is in the water leg 44, control is passed from logic block 83 to logic block 84 where the rate is compared with the operator entered minimum flow rate. If it is greater than the operator input, control is passed to the logic block 85 where a determination is made if the elapsed time exceeds an operator entered time limit. If so, control is passed to logic block 15 where alarm logic indicates a stuck open valve in water leg 46.

ALARM

Table 9 illustrates the alarm routine according to the software of the invention. Once alarm logic block 15 is entered by the program, control is passed to logic block 90 where a report is generated of the alarm sensed and the time of occurrence. Logic control passes to logic block 91 where a determination is made as to whether or not an operator input of an alarm option to abort the testing sequence is present. If so, logic control passes to logic block 92 and all wells are diverted to production and an alarm beacon is lighted. If there is no operator entered alarm option to abort the sequence, logic control is passed to logic block 93 where a determination is made as to whether or not an operator enter option to abort the well is present. If it is present, control is passed to logic block 94 where the well in test is diverted to production and the next well is tested in sequence. If the operator input alarm option is not present, logic control is passed to logic block 95. The only other operator entered option is to continue testing and the routine is then exited.

Various modifications and alterations in the described structures and programs will be apparent to those skilled in the art of the foregoing description which does not depart from the spirit of the invention. For this reason, these changes are desired to be included in the appended claims. The appended claims recite the only limitations to the present invention in the descriptive manner which is employed for setting forth the embodiments and is to be interpreted as illustrative and not limitative.

APPENDIX

TABLE 1

Automatic Well Test Unit Software
OVERVIEW

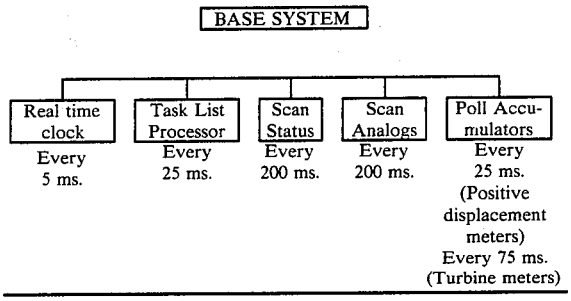

TABLE 2A

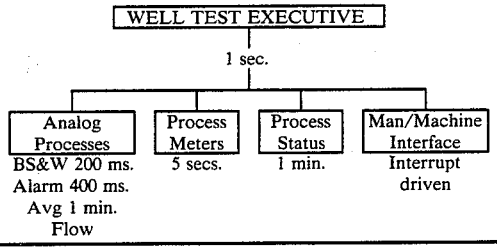

TABLE 2B

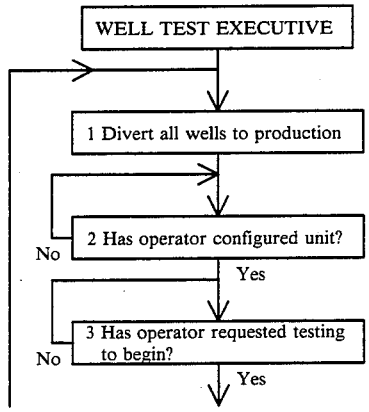

TABLE 2B-continued

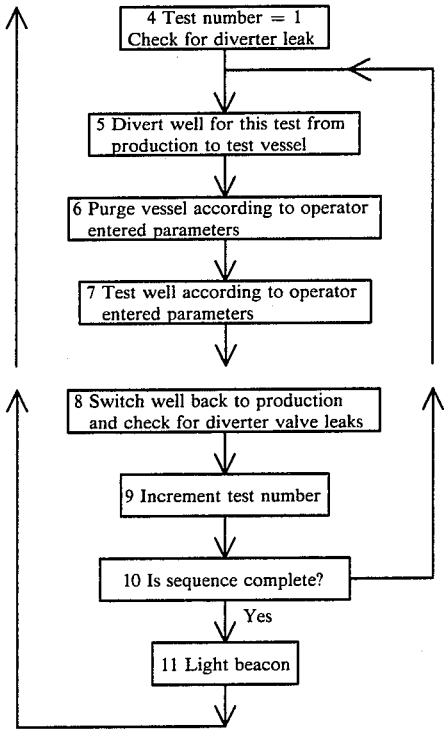

TABLE 3

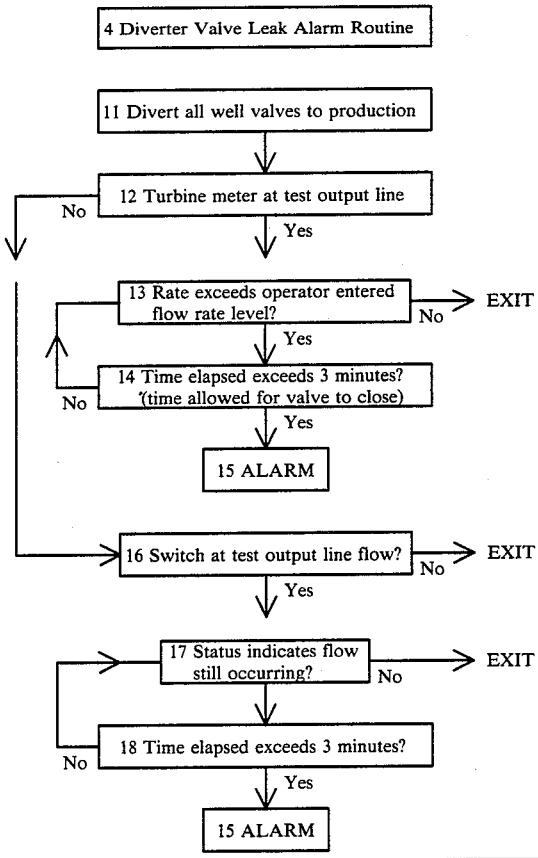

TABLE 4
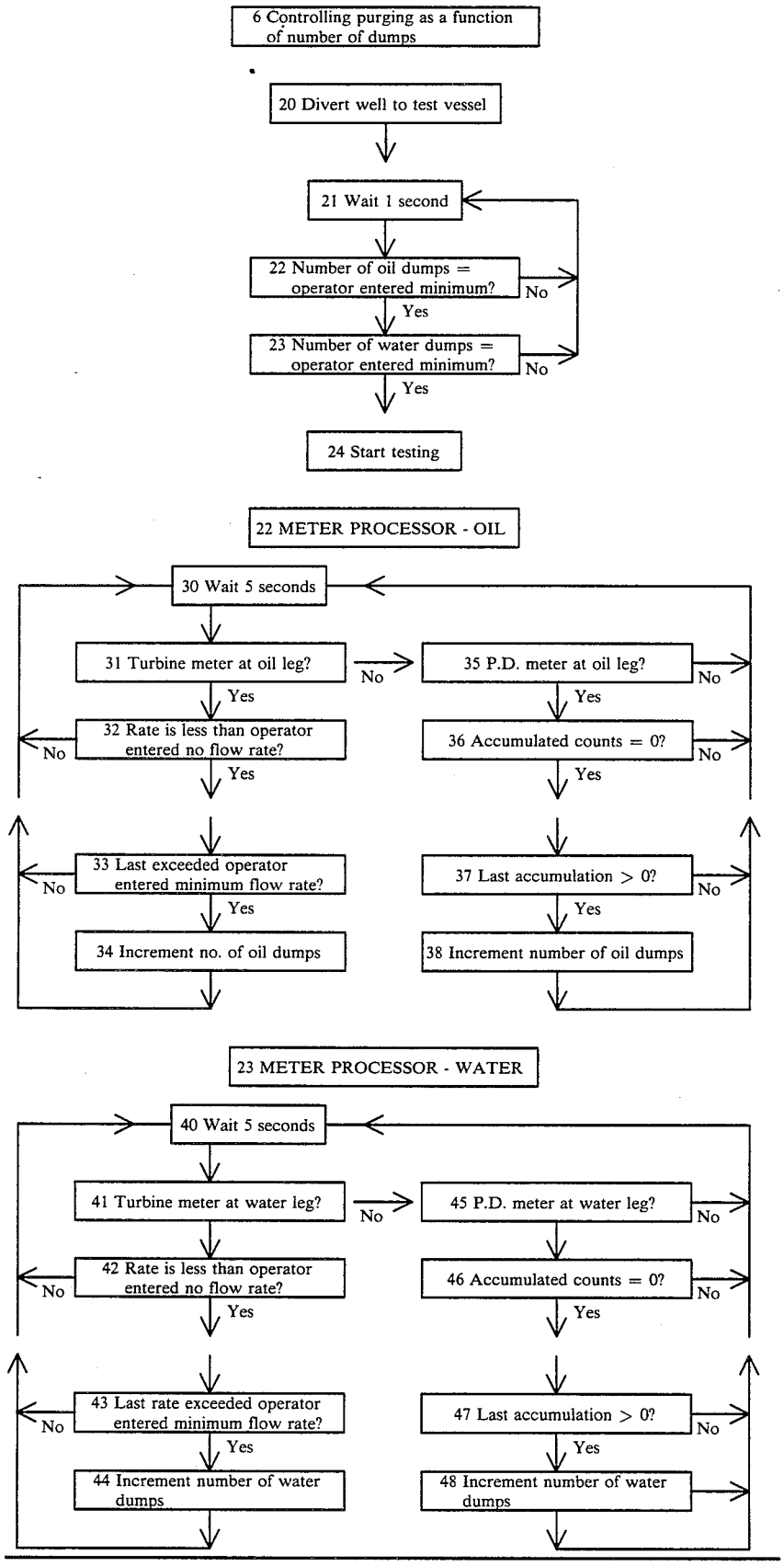

TABLE 5
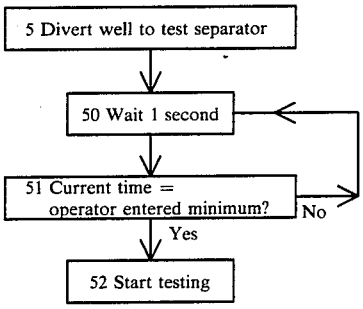
TABLE 6
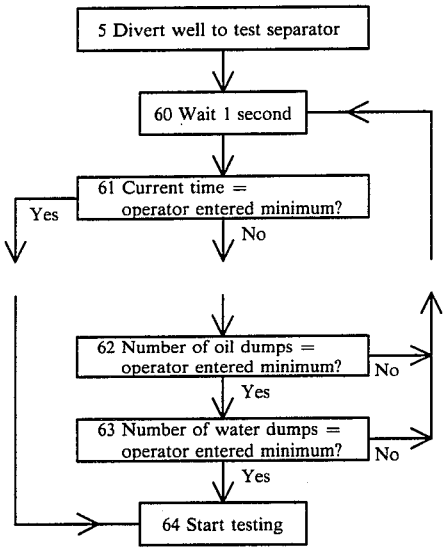
TABLE 7
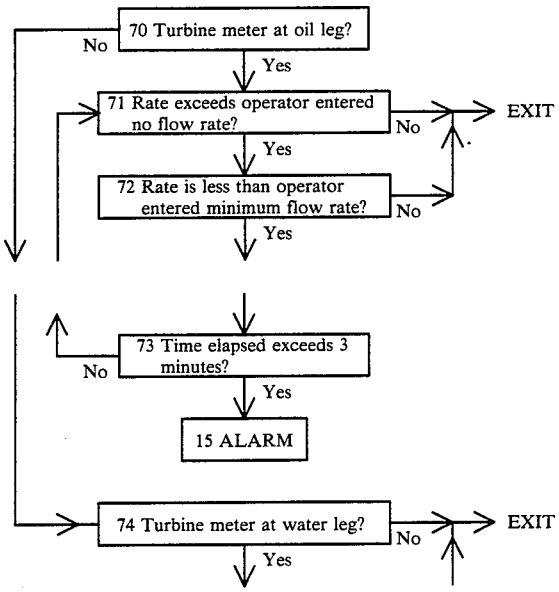
TABLE 7-continued
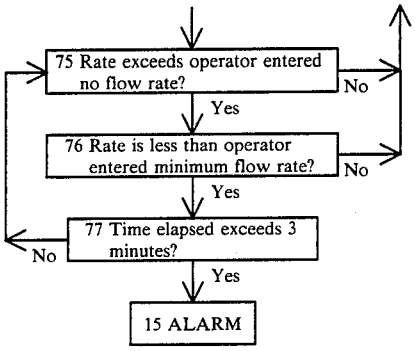
TABLE 8
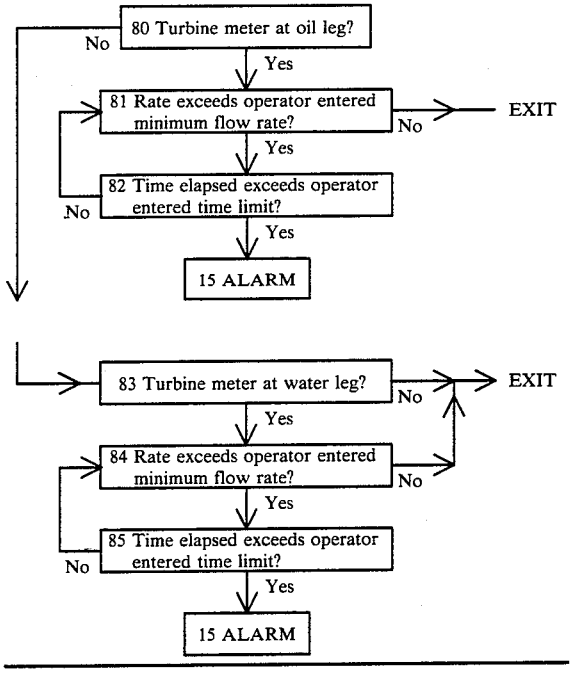
TABLE 9
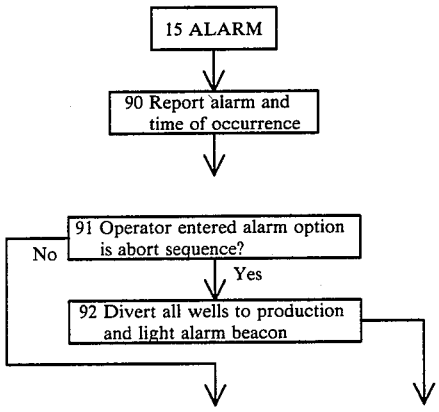

TABLE 9-continued

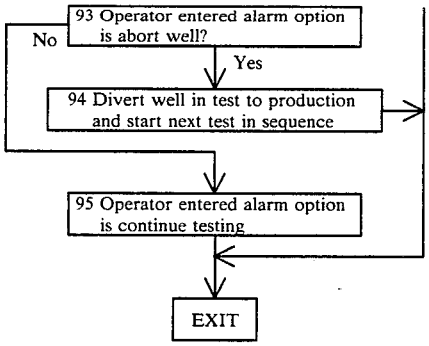

What is claimed is:

1. An automatic well test system for testing a plurality of wells in an oilfield comprising, a plurality of controllable diverter valves, one valve disposed in each output line of each well, each diverter valve having a divert line and a production line, each production line connected to a common production header, a test header to which the divert line of each diverter valve is connected, the test header having a test output line, flow determining means disposed in said test header output line for generating a signal indicating flow in said test header output line, a test separator having an input port to which the test header output line is connected, and having an emulsion oil output line, a water/oil measuring means disposed in said emulsion oil output line for generating a signal indicative of the ratio of water to oil in said line, a flow rate measuring means disposed in said emulsion oil output line for generating a signal indicative of the flow rate of the emulsion oil flowing in said line, and a system controller means responsive to operator data inputs for automatically testing each well by, prior to the testing of each well in sequence, signalling all of said controllable diverter valves to connect each well to said production header, maintaining the connection of each well to said production header for a predetermined wait time period, monitoring said flow determining means in said test header output line, and generating an alarm signal if a signal is generated by said flow determining means during said predetermined wait time, said alarm signal signifying that at least one of said diverter valves is leaking via its divert line, and sequentially signalling each of said controllable diverter valves associated with a well to direct the output of such well to its divert line and to said test separator, and for each well in sequence, purging said test separator via said emulsion oil output line, and generating in response to said signal indicative of said water to oil ratio flowing in said emulsion oil output line and to said signal indicative of the flow rate of the emulsion oil flowing in said emulsion oil output line, a signal representative of the net oil flow rate produced in each well.

2. An automatic well test system for testing a plurality of wells in an oilfield comprising a plurality of controllable diverter valves, one valve disposed in each output line of each well, each diverter valve having a divert line and a production line, each production line connected to a common production header, a test header to which the divert line of each diverter valve is connected, the test header having a test output line, a test separator having an input port to which the test header output line is connected, and having an emulsion oil output line and a free water output line, and having means for separating input fluid into a first section of emulsion oil and free water and a second section of emulsion oil, and having a first dump signalling means in said first section for generating a first dump signal indicative that free water in the separator is at a predetermined level, and having a second dump signalling means in said second section for generating a second dump signal indicative that emulsion oil in the second section is at a predetermined level, a dump valve disposed in said free water output line responsive to said first dump signal for dumping free water in said first section of said test separator, a dump valve disposed in said emulsion oil output line responsive to said second dump signal for dumping emulsion oil in said second section of said test separator, a water/oil measuring means disposed in said emulsion oil output line for generating a signal indicative of the ratio of water to oil in said line, a flow rate measuring means disposed in said emulsion oil output line for generating a signal indicative of the flow rate of the emulsion oil flowing in said line, a flow rate measuring means disposed in said free water output line for generating a signal indicative of the flow rate of the free water flowing in the free water output line, and a system controller means responsive to operator data inputs for automatically testing each well by, sequentially signalling each of said controllable diverter valves associated with a well to direct the output of such well to its divert line and to said test separator, and in sequence for each well, purging said test separator of free water and emulsion oil by counting the number of free water dumps and the number of emulsion oil dumps occurring after a well has been switched to the test separator and comparing the number of such dumps with respect to operator input data for such dumps for enabling the well test when the number of dumps specified by said operator input data has been accomplished, and for each well in sequence, testing the well by generating a net oil flow rate signal in response to said signals indicative of said water to oil ratio flowing in said emulsion oil output line and to said signal indicative of the flow rate of the emulsion oil flowing in said emulsion oil output line signal and to said signal indicative of the flow rate of the free water flowing in the free water output line.

3. The automatic well test system of claim 2 wherein said system controller means includes additional means for alternatively controlling the purging of the test vessel for a time period equal to a purge time data input and beginning the test of a well after such time period has passed.

4. The automatic well test system of claim 3 wherein said system controller means includes additional means for stopping the purging of the separator and beginning the testing of a well on the first to occur of (1) the time period since the beginning of the purge being equal to the purge time data input, or (2) the number of free water dumps is greater than or equal to the operator input data for such water dumps and the number of emulsion oil dumps is greater than or equal to the operator input data for such emulsion oil dumps.

5. An automatic well test system for testing a plurality of wells in an oilfield comprising, a test separator having an input port and an output line and a dump signal generating means in said separator for generating a dump signal indicative that the liquid in the test separator is at a predetermined level, a dump valve in said output line responsive to said dump signal for opening said output line, a flow rate measuring means disposed in said output line for generating a signal indicative of the flow rate in said output line, an automatic controlling means for sequentially testing each well in the oilfield and having means for sequentially diverting the flow of each well to said test separator, means for purging the test separator via said output line to insure that only fluid from the well to be tested is in the test separator, means for measuring the net oil flowing in the well under test, and means for generating a leaking dump valve alarm signal if while said dump valve is closed, said flow rate measuring means measures greater than a predetermined flow rate for greater than a predetermined time period.

6. The system of claim 5 further comprising means for generating a stuck open dump valve alarm signal if after a predetermined time required to dump said liquid in the test separator, the signal indicative of the flow rate in said output line is greater than a predetermined level.

7. In an automatic well test system for testing a plurality of wells in an oilfield including a test separator and a test header connected to each of said wells and a test header output line connected between said test separator and said test header and a flow determining means in said header output line, a method for detecting leaks in any of the diverter valves prior to the testing of each well in sequence comprising the steps of signalling all of said controllable diverter valves to connect each well to the production header, maintaining the connection of each well to the production header for a predetermined wait time period, monitoring said flow determining means in said test header output line, and generating an alarm signal if a signal is generated by said flow determining means during said predetermined wait time, said alarm signifying that at least one of said diverter valves is leaking.

8. In an automatic well test system for testing a plurality of wells in an oilfield including a test separator and a test header connected to each of said wells and a test header output line connected between said test separator and said test header, said test separator having means for separating within the separator emulsion oil from free water and having means for dumping free water via a free water output line after free water reaches a predetermined level in the separator and means for dumping emulsion oil via an emulsion oil output line after emulsion oil reaches a predetermined level in the separator, a method for purging the test separator of emulsion oil and free water comprising the steps of initiating purging of the test separator after a well has been switched to the test separator, counting the number of free water dumps and the number of emulsion oil dumps occurring after the initiation of the purging of the test separator, stopping the purging of the test separator when the number of free water dumps is greater than or equal to the operator input data for such water dumps and the number of emulsion oil dumps is greater than or equal to the operator input data for such emulsion oil dumps.

* * * * *